US006238621B1

(12) United States Patent
Kalota et al.

(10) Patent No.: US 6,238,621 B1
(45) Date of Patent: May 29, 2001

(54) CORROSION INHIBITING COMPOSITIONS

(75) Inventors: Dennis J. Kalota, Fenton; Yueting Chou; David C. Silverman, both of Chesterfield, all of MO (US)

(73) Assignee: Solutia Inc., St. Louis, MO (US)

( * ) Notice: Subject to any disclaimer, the term of this patent is extended or adjusted under 35 U.S.C. 154(b) by 0 days.

(21) Appl. No.: 09/317,834

(22) Filed: May 25, 1999

Related U.S. Application Data

(60) Provisional application No. 60/086,941, filed on May 27, 1998, and provisional application No. 60/093,875, filed on Jul. 23, 1998.

(51) Int. Cl.[7] ..... C23F 11/10; C09K 3/00

(52) U.S. Cl. ..... 422/16; 422/7; 252/390; 252/394

(58) Field of Search ..... 252/390, 394; 422/7, 16

(56) References Cited

U.S. PATENT DOCUMENTS

| | | | | |
|---|---|---|---|---|
| 2,941,953 | | 6/1960 | Hatch et al. . | |
| 3,791,855 | * | 2/1974 | Korpics | 252/390 |
| 3,945,931 | * | 3/1976 | Bussi et al. | 508/435 |
| 4,085,054 | * | 4/1978 | Bussi et al. | 508/430 |
| 4,642,221 | * | 2/1987 | Hansen et al. | 422/16 |
| 4,657,785 | * | 4/1987 | Kelly et al. | 427/255.6 |
| 4,675,158 | * | 6/1987 | Klindera | 422/16 |
| 4,874,579 | * | 10/1989 | Schmid et al. | 422/16 |
| 5,401,428 | * | 3/1995 | Kalota et al. | 508/508 |
| 5,443,651 | | 8/1995 | Kalota et al. | 134/2 |
| 5,599,779 | | 2/1997 | Karol et al. | 508/283 |
| 5,616,544 | * | 4/1997 | Kalota et al. | 508/508 |

FOREIGN PATENT DOCUMENTS

| | | |
|---|---|---|
| 495434 | 3/1976 | (CH) . |
| 2015075 | 10/1970 | (DE) . |
| 0249162 | 6/1987 | (EP) . |
| 834571 | 5/1960 | (GB) . |
| 2045738 | 11/1980 | (GB) . |
| 53096941 | 2/1977 | (JP) . |
| 56041388 | 9/1979 | (JP) . |
| 56-058977 | 5/1981 | (JP) . |
| 57-039177 | 3/1982 | (JP) . |
| 8337562 | 12/1996 | (JP) . |
| 9704052 | 2/1997 | (WO) . |

* cited by examiner

*Primary Examiner*—Jill Warden
*Assistant Examiner*—LaToya I. Cross
(74) *Attorney, Agent, or Firm*—Thompson Coburn LLP; Greg Upchurch; Paul A. Lesko

(57) ABSTRACT

There are disclosed corrosion inhibiting compositions comprising (a) at least one amido acid or salt thereof and (b) at least one of an aryltriazole or 3-amino-1,2,4-triazole wherein the molar ratio of (a) to (b) is about 0.34:1 to about 5:1, and aqueous metal working fluids containing the corrosion inhibiting compositions of the invention.

15 Claims, No Drawings

CORROSION INHIBITING COMPOSITIONS

CROSS REFERENCE TO RELATED APPLICATIONS

This application claims priority under 35 U.S.C. § 119(e) of U.S. Provisional Patent application No. 60/086,941 filed May 27, 1998, entitled "CORROSION INHIBITING AND AQUEOUS METAL COMPOSITIONS" and U.S. Provisional Patent application No. 60/093,875 filed Jul. 23, 1998, entitled "CORROSION INHIBITING COMPOSITIONS".

This invention relates to corrosion inhibiting compositions. This invention further relates to aqueous metal working compositions containing the corrosion inhibiting compositions of the invention and a method of inhibiting corrosion of ferrous metals.

BACKGROUND OF THE INVENTION

It is known that corrosion is a problem in aqueous fluids utilized for the working of metals. Corrosion inhibitors are commonly added to aqueous fluids to mitigate corrosion of ferrous metals. Typical examples of corrosion inhibitors known in the art are zinc chromate, dithiophosphates, metal sulfonates, alkanolamines, alkyl amines, borate compounds, carboxylic acids including polyaspartic acid at high pH (10 and above), alkyl amidocarboxylic acids, sodium molybdate, boric acid with various ethanol amines, benzoic acid and nitro derivatives thereof, ammonium benzoate, triethanolamine salts of carboxylic acids with a carboxymethyl thio group, tungstates, phosphates, polyphosphates, phosphonates, nitrates and silicates.

U.S. Pat. No. 5,723,061 discloses an antifreeze composition containing a corrosion inhibitor system comprising a mixture of at least two aromatic or aliphatic dicarboxylic acids or alkali metal, ammonium or amine salts thereof, at least one 1,3-diazole chosen from imidazole, benzimidazole, imidazoline and the hydrocarbon derivatives thereof, and at least one triazole compound such as benzotriazole, tolyltriazole, or N-substituted derivatives thereof. The '061 patent also states that GB-1,004,259 discloses a corrosion inhibitor composition comprising a mixture of benzotriazole and/or methylbenzotriazole and an alkali metal, ammonium, amine or alkanolamine salt of a $C_6$ to $C_{30}$ saturated dicarboxylic acid.

WO 96/39549 discloses corrosion inhibiting formulations for use in closed water systems comprising at least one water soluble fatty acid salt of the formula $R^1(COOX)_n$ wherein $R^1$ is alkyl or hydroxyalkyl having at least 2 carbon atoms, preferably 2–18 carbon atoms, and n is 2 or 3, and optionally at least one additive which may be a corrosion inhibitor, selected from the group of alkali metal borates, alkali metal molybdates, hydrocarbyl triazoles, silicates, morpholine, ethylenediamine, pyridine and pyrrolidine.

U.S. Pat. No. 3,945,931 discloses an aqueous metal working fluid containing amido acids of the formula

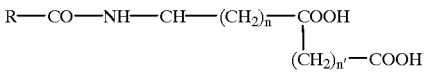

wherein R is an open chain aliphatic hydrocarbon group having between 9 and 25 carbon atoms, and n and n' are whole numbers or zero, the same or not, the sum of n and n' being equal to 1 or 2. The fluids of the '931 patent optionally contain salts of phosphoric esters, as well as other additives such as anti-foam agents, bactericides and anti-corrosive agents. The anti-corrosive agents can be alkaline nitrates, phosphates, borates, etc.

U.S. Pat. No. 5,599,779 discloses synergistic rust inhibitor compositions consisting of N-acyl sarcosines of the formula

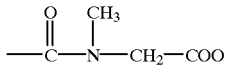

wherein R represents alkyl or alkenyl group of 8–18 carbon atoms, a dicarboxylic acid of the formula $HOOC(CH_2)_xCOOH$ wherein x is an integer from 4 to 46, and an amine selected from a primary, secondary or tertiary alkyl amine or an imidazoline, and the molar ratio of sarcosine to dicarboxylic acid to amine is about 2:1:2 to 7:1:2.

While amido acids have been disclosed for use in aqueous metal working fluids and triazoles have been disclosed as corrosion inhibitors in aqueous compositions, it has now been surprisingly discovered that the amido acids or salts thereof of the invention produce a synergistic corrosion inhibiting effect in aqueous compositions, particularly aqueous metal working compositions, when combined in specific proportions with the aryltriazoles or 3-amino-1,2,4-triazole of the invention.

BRIEF SUMMARY OF THE INVENTION

It is an object of the invention to provide corrosion inhibiting compositions having a synergistic corrosion inhibiting effect. It is a further object of the invention to provide aqueous metal working fluid compositions containing the corrosion inhibiting compositions of the invention.

According to the invention, a corrosion inhibiting composition is provided which comprises (a) at least one amido acid or salt thereof having the formula

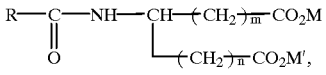

and (b) at least one of an aryltriazole having the formula

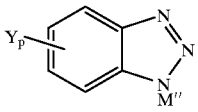

or 3-amino-1,2,4-triazole wherein the molar ratio of (a) to (b) is about 0.34:1 to about 5:1.

Further according to the invention, a metal working composition is provided which comprises water and a corrosion inhibiting composition in an amount effective to inhibit corrosion at a pH in the range of 6–12, wherein the corrosion inhibiting composition is as defined above. The metal working compositions of the invention optionally contain a polyaspartic polymer in the acid, salt or amide form thereof. Such polyaspartic polymer containing metal working fluids are described in U.S. Pat. Nos. 5,401,428 and 5,616,544, which are incorporated by reference herein. In addition, a method of making the above metal working composition is provided.

Still further according to the invention, a method of inhibiting corrosion in an aqueous metal working composition is provided which comprises adding the above corrosion inhibiting composition to an aqueous metal working fluid composition in an amount effective to inhibit corrosion at a pH in the range of 6–12.

DETAILED DESCRIPTION OF THE INVENTION

A first embodiment of the invention relates to a corrosion inhibiting composition comprising (a) at least one amido acid or salt thereof having the formula

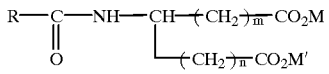

wherein R is an alkyl or alkenyl group having about 4 to about 21 carbon atoms, M and M' are cations independently selected from hydrogen, alkali metal or amine salts, and m and n independently represent an integer from 0 to 2; and (b) at least one of an aryltriazole having the formula

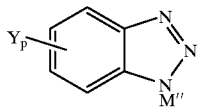

or 3-amino-1,2,4-triazole, wherein Y is an alkyl group having 1 to about 6 carbon atoms or —$COO^-M^+$, M" is hydrogen or an alkali metal, and p is an integer from 0 to 4; wherein the molar ratio of (a) to (b) is about 0.34:1 to about 5:1.

The amido acids or salts thereof of the invention are represented by the formula:

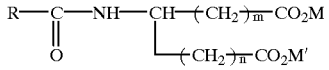

wherein R is an alkyl or alkenyl group having about 4 to about 21 carbon atoms, M and M' are cations independently selected from hydrogen, alkali metal or amine salts, and m and n independently represent an integer from 0 to 2. Suitable amine salts include the cations derived from ammonia and any water-soluble amine-containing organic compound. Examples of suitable amine salts include, but are not limited to, cations represented by the formula $(R')_4N^+$ wherein each R' is independently hydrogen, alkyl having 1–10 carbon atoms, aminoalkyl having 2–10 carbon atoms, or hydroxyalkyl having 2–10 carbon atoms. When each of R' is hydrogen, the cation is ammonium, i.e. $NH_4N^+$. When at least one R' is other than hydrogen, $(R')_4N^+$ can be a primary, secondary or tertiary ammonium, or a quaternary ammonium. Preferably, the amine salt is triethanolammonium or ammonium. Preferably, m is 0 and n is 1 or 2. More preferably, m is 0 and n is 2. It is also preferred that at least one of M and M' is other than hydrogen. When at least one of M and M' is other than hydrogen, it is preferably an alkali metal or trihydroxyalkylammonium, and more preferably sodium, potassium or triethanolammonium. The number of carbon atoms in R is preferably about 6 to about 17 carbon atoms, and more preferably about 7 to about 15 carbon atoms.

Examples of the amido acids or salts thereof include, but are not limited to, N-cocoyl-L-glutamic acid, sodium N-cocoyl-L-glutamate, triethanolamine N-cocoyl-L-glutamate, triethanolamnine N-lauroyl-L-glutamate, sodium N-lauroyl-L-glutamate, N-stearoyl-L-glutamic acid, sodium N-stearoyl-L-glutamate, N-cocoyl-L-aspartic acid, sodium N-cocoyl-L-aspartate, triethanolamine N-cocoyl-L-aspartate, triethanolamine N-lauroyl-L-aspartate, sodium N-lauroyl-L-aspartate, N-stearoyl-L-aspartic acid and sodium N-stearoyl-L-aspartate. The currently preferred amido acids or salts thereof are N-cocoyl-L-glutamic acid, N-lauroyl-L-glutamic acid, and the salts thereof.

The aryltriazoles of the invention are represented by the formula

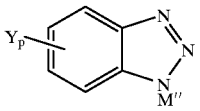

wherein Y is an alkyl group having 1 to about 6 carbon atoms or —$COO^-M^{30}$ , M" is hydrogen or an alkali metal, and p is an integer from 0 to 4. Preferably, M" is hydrogen, p is 0 or 1 and Y is methyl, ethyl or butyl.

Examples of the aryltriazoles include, but are not limited to, benzotriazole, tolyltriazole, 5-ethylbenzotriazole and 5-butylbenzotriazole. The currently preferred aryltriazoles are benzotriazole and tolyltriazole.

The relative amounts of (a) amido acid or salt thereof and (b) aryltriazole or 3-amino-1,2,4-triazole necessary in the corrosion inhibiting composition of the invention can be conveniently expressed as a mole ratio of (a) to (b). Broadly, the mole ratio of (a) to (b) is about 0.34:1 to about 5:1, preferably about 0.5:1 to about 2.5:1, and most preferably about 0.85:1 to about 2.2:1.

The corrosion inhibiting composition of the invention can be diluted with a diluent, preferably water. When the corrosion inhibiting composition contains a diluent, the amido acid or salt thereof and aryltriazole or 3-amino-1,2,4-triazole are present in an amount effective to inhibit corrosion. Generally, the amido acid or salt thereof is present at a level of at least 0.125 wt. %, and the aryltriazole or 3-amino-1,2,4-triazole is present at a level of at least 0.025 wt. %. Preferably, the amido acid or salt thereof is present at a level of at least 0.2 wt. %, and the aryltriazole or 3-amino-1,2,4-triazole is present at a level of at least 0.05 wt. %. More preferably, the amido acid or salt thereof is present at a level of at least 0.25 wt. %, and the aryltriazole or 3-amino-1,2,4-triazole is present at a level of at least 0.1 wt. %, and most preferably, the amido acid or salt thereof is present at a level of at least 0.5 wt. %, and the aryltriazole or 3-amino-1,2,4-triazole is present at a level of at least 0.2 wt. %. The upper level of amido acid or salt thereof and aryltriazole or 3-amino-1,2,4-triazole is readily determined by one skilled in the art and is that amount which is soluble in the diluted corrosion inhibiting composition.

When the corrosion inhibiting composition is diluted with water, the amount of amido acid or salt thereof necessary in the corrosion inhibiting composition to effectively inhibit corrosion will depend on the type of water used in the dilution. Water which contains higher levels of hardness, expressed as calcium and magnesium levels, will require higher levels of the amido acid or salt thereof to have equivalent effectiveness at inhibiting corrosion. The preferred water for use in the diluted corrosion inhibiting composition is soft water or deionized (DI) water, with DI water being most preferred.

The effective pH range of the diluted corrosion inhibiting composition is that pH in which corrosion inhibition is achieved and is generally in the range of 6 to 12. The preferred pH range of the diluted corrosion inhibiting composition is about 7 to about 10, and more preferably about 7.5 to about 9.5.

The corrosion inhibiting compositions of the invention are useful in inhibiting corrosion in ferrous metals including, but not limited to, iron, steel (carbon steel and low alloy carbon steel), high speed steel and stainless steel.

A second embodiment of the invention relates to a metal working composition comprising water and a corrosion inhibiting composition in an amount effective to inhibit corrosion at a pH in the range of 6–12, preferably about 7 to about 10, and more preferably about 7.5 to about 9.5, wherein the corrosion inhibiting composition comprises the corrosion inhibiting composition described above. When the metal working composition is used to work aluminum and similar metals, the effective pH range is about 7 to about 10, and preferably about 7.5 to about 9.5.

The amount of corrosion inhibiting composition present in the metal working compositions of the invention is generally in the range of from 0.25 wt. % to about 2.5 wt. % with the amido acid or salt thereof being present at a level of at least 0.125 wt. %, and the aryltriazole or 3-amino-1,2,4-triazole being present at a level of at least 0.025 wt. %. The amount of corrosion inhibiting composition present in the metal working compositions of the invention is preferably in the range of from about 0.25 wt. % to about 2 wt. % with the amido acid or salt thereof being present at a level of at least 0.2 wt. %, and the aryltriazole or 3-amino-1,2,4-triazole being present at a level of at least 0.05 wt. %, more preferably in the range of from about 0.35 wt. % to about 1.8 wt. % with the amido acid or salt thereof being present at a level of at least 0.25 wt. %, and the aryltriazole or 3-amino-1,2,4-triazole being present at a level of at least 0.1 wt. %, and most preferably in the range of from about 0.7 wt. % to about 1.5 wt. % with the amido acid or salt thereof being present at a level of at least 0.5 wt. %, and the aryltriazole or 3-amino-1,2,4-triazole being present at a level of at least 0.2 wt. %.

The metal working composition of the invention optionally contains a polyaspartic polymer in the acid, salt or amide form thereof wherein the concentration of the polyaspartic polymer is in the range of from about 0.5 wt. % to about 70 wt. %, preferably about 3 wt. % to about 50 wt. %, of the metal working composition. The polyaspartic polymers for use in the invention are described in U.S. Pat. No. 5,616,544.

The metal working compositions of the invention are useful in various metal working operations including, but not limited to, cutting, threading, bending, grinding, broaching, tapping, planing, gear shaping, reaming, deep hole drilling/gundrilling, drilling, boring, hobbing, milling, turning, sawing and shaping of carious ferrous and non-ferrous metals. The metal working compositions of the invention are useful in the various metal working operations noted above with any number of types of metals. In particular, they are useful in working ferrous metals such as iron, steel (carbon steel and low alloy carbon steel), and stainless steel. Non-ferrous metals which can be worked with metal working compositions of this invention include, but are not limited to, titanium, zirconium, copper, brass, nickel, cobalt, magnesium, aluminum and alloys thereof. Such metals are safely worked with lubricity supplied by the aqueous metal working fluids of this invention.

A third embodiment of the invention relates to a method of making the metal working composition of the invention described above and comprises admixing (i) water, and (ii) the corrosion inhibiting composition described above in an amount effective to inhibit corrosion at a pH in the range of 6–12.

Admixing the water and corrosion inhibiting composition of the invention can be conducted using conventional mixing techniques known to those of ordinary skill in the art.

A fourth embodiment of the invention relates to a method of inhibiting corrosion in an aqueous metal working composition comprising adding a corrosion inhibiting composition described above to the aqueous metal working fluid composition in an amount effective to inhibit corrosion at a pH in the range of 6–12. The corrosion inhibiting compositions of the invention are used to inhibit corrosion of ferrous metals in the metal working operations described above when working metal using the aqueous metal working compositions of the invention.

EXAMPLES

Example 1

The procedure for preparing solutions for the cast iron chip corrosion tests was as follows. To a 100 cc beaker is added with 40 grams of deionized water and the necessary ingredients in their required amounts. Stirring was sometimes needed to obtain complete dissolution. A 10% (w/v) caustic solution was used to adjust the solution to the required pH. Then additional deionized water was added to bring the total solution weight to 50 grams. For example, the solution of 1% N-cocoyl-L-glutamate and 0.2% benzotriazole was prepared by dissolving 0.5 gram of N-cocoyl-L-mono sodium glutamate and 0.1 gram of benzotriazole in 40 grams of water. The solution pH was adjusted to 7 with the caustic solution. Then more water was added to the solution to bring it to a total weight of 50 grams. The other solutions were prepared in a similar manner.

A cast iron chip test was conducted to determine the corrosion repression properties of aqueous solutions of this invention. The procedure was modified from that given in ASTM D-4627, "Standard Test Method for Iron Chip Corrosion for Water-Dilutable Metalworking Fluids". The procedure was as follows. Whatman #934 filter paper was placed in three 35×10 mm Falcon dishes, one paper per dish with rough side up. Four grams of cast iron chips (obtained from IAMS Inc., Technical Center, 1111 Edison Dr., Cincinnati, Ohio) were spread evenly across each filter paper. Five milliliters of the test solution were added to each dish on top of the chips. The dishes were covered and left for about 24 hours at room temperature. After that time, the solution and chips were discarded and the papers were rinsed with tap water to remove any adhering metal particulates. The filter papers were placed on an absorbent pad to dry. The area of any stains was measured and is reported in the Tables in the examples.

Solutions of N-cocoyl-L-glutamate (CG) were tested with and without benzotriazole (BT) as well as solutions of BT alone. The results are shown in Table 1.

TABLE 1

| Concentration of N-cocoyl L-glutamate (CG) and Benzotriazole (BT) | % Stain Paper #1 | % Stain Paper #2 | % Stain Paper #3 | pH |
|---|---|---|---|---|
| 1 wt % CG<br>0.1 wt % BT | 0 | 0 | 0 | 7.93 |
| .175 wt % CG<br>.2 wt % BT | 0 | 0 | 0 | 7.98 |
| .2 wt % CG<br>.1 wt % BT | 0 | 0 | 0 | 7.95 |
| .20 wt % CG<br>.1 wt % BT | 0 | 0 | 0 | 8.97 |
| .25 wt % CG | 0 | 0 | 0 | 6.94 |

TABLE 1-continued

| Concentration of N-cocoyl L-glutamate (CG) and Benzotriazole (BT) | % Stain Paper #1 | % Stain Paper #2 | % Stain Paper #3 | pH |
|---|---|---|---|---|
| .2 wt % BT | | | | |
| .25 wt % CG | 0 | 0 | 0 | 7.94 |
| .2 wt % BT | | | | |
| .25 wt % CG | 0 | 0 | 0 | 8.97 |
| .2 wt % BT | | | | |
| 1 wt % CG | 0 | 0 | 0 | 7 |
| .2 wt % BT | | | | |
| 1 wt % CG | 0 | 0 | 0 | 8 |
| .2 wt % BT | | | | |
| 1 wt % CG | 0 | 0 | 0 | 9 |
| .2 wt % BT | | | | |
| .25 wt % CG | 5–10 | 5–10 | 1–3 | 8.10 |
| .025 wt % BT | | | | |
| .125 wt % CG | 0 | 10 | 25 | 6.99 |
| .2 wt % BT | | | | |
| .125 wt % CG | 5 | 5 | 1–3 | 7.97 |
| .2 wt % BT | | | | |
| .15 wt % CG | <1 | 5–10 | <1 | 7.90 |
| .2 wt % BT | | | | |
| .125 wt % CG | 5 | 5 | 5 | 8.93 |
| .2 wt % BT | | | | |
| .2 wt % CG | 25 | 25 | 25 | 8.10 |
| .05 wt % BT | | | | |
| .20 wt % CG | 25 | 25 | 25 | 8.95 |
| .1 wt % BT | | | | |
| .2 wt % CG | 25 | 25 | 25 | 9.02 |
| .05 wt % BT | | | | |
| .15 wt % CG | 10–25 | 25 | 10–25 | 6.98 |
| .2 wt % BT | | | | |
| 1 wt % CG (No BT) | >90 | >90 | >90 | 6.97 |
| 1 wt % CG (No BT) | 50 | 75 | 75 | 7.93 |
| 1 wt % CG (No BT) | 15 | 15 | 50 | 8.93 |
| .2 wt % BT (No CG) | 25–50 | 25–50 | 25–50 | 7.96 |

Example 2

Solutions of N-stearoyl L-Glutamate (SG) were tested with and without benzotriazole (BT) following the procedure outlined in Example 1. The results are shown in Table 2.

TABLE 2

| Concentration of N-stearoyl L-glutamate (SG) and Benzotriazole (BT) | % Stain Paper #1 | % Stain Paper #2 | % Stain Paper #3 | pH |
|---|---|---|---|---|
| 1 wt % SG | <1 | <1 | <1 | 6.99 |
| .2 wt % BT | | | | |
| 1 wt % SG | 1 | 1 | 1 | 8.10 |
| .2 wt % BT | | | | |
| 1 wt % SG | 0 | 1 | 1 | 9.04 |
| .2 wt % BT | | | | |
| 1 wt % SG (No BT) | 50 | 25 | 25 | 6.00 |
| 1 wt % SG (No BT) | 100 | 100 | 100 | 7.96 |
| 1 wt % SG (No BT) | 100 | 100 | 100 | 9.07 |
| 1 wt % SG | 0 | 0 | 0 | 8.06 |
| .2 wt % BT | | | | |
| 1 wt % SG | 2 | 2 | 2 | 8.93 |
| .2 wt % BT | | | | |
| 1 wt % SG (No BT) | 100 | 100 | 100 | 7.93 |
| 1 wt % SG (No BT) | 100 | 100 | 100 | 8.90 |

Example 3

Following is a comparison of the synergistic effect of tolyltriazole (TT), or 3-amino-1,2,4-triazole (AT) as alternatives to benzotriazole with N-cocoyl L-glutamate (CG) following the procedure outlined in Example 1.

TABLE 3

| Concentrations | % Stain Paper #1 | % Stain Paper #2 | % Stain Paper #3 | pH |
|---|---|---|---|---|
| 1 wt % CG | 0 | 0 | 0 | 6.95 |
| .2 wt % TT | | | | |
| 1 wt % CG | 0 | 0 | 0 | 8.99 |
| .2 wt % TT | | | | |
| 1 wt % CG | 0 | 0 | 0 | 7.98 |
| .2 wt % AT | | | | |
| .2 wt % AT (No CG) | 100 | 100 | 100 | 8.03 |
| 1 wt % CG (No triazole) | 100 | 100 | 100 | 6.94 |
| 1 wt % CG (No triazole) | 100 (Very light) | 50 (Very light) | 100 (Very light) | 7.90 |
| .2 wt % TT (No CG) | 50–75 | 50–75 | 50–75 | 6.98 |
| .2 wt % TT (No CG) | 50–75 | 50–75 | 50–75 | 9.04 |

Example 4

Table 4 shows the synergism between n-caproyl L-glutarnate (C6G) and benzotriazole (BT) for inhibition of ferrous metal corrosion following the procedure outlined in Example 1.

TABLE 4

| Concentrations | % Stain Paper #1 | % Stain Paper #2 | % Stain Paper #3 | pH |
|---|---|---|---|---|
| 1 wt % C6G | 0 | 0 | 0 | 7.02 |
| 0.2 wt % BT | | | | |
| 1 wt % C6G | 0 | 0 | 0 | 9.01 |
| 0.2 wt % BT | | | | |
| 1 wt % C6G (No BT) | 100 | 100 | 100 | 6.98 |
| 1 wt % C6G (No BT) | 100 | 100 | 100 | 8.97 |

Example 5

Solutions containing various levels of benzotriazole (BT) and N-cocoyl-L-glutamate (CG) and prepared using deionized water and St. Louis County Tap water (Creve Coeur, Mo.) were examined for corrosion by the procedure in Example 1. The objective was to compare the effect of deionized water vs. St. Louis County tap water on ferrous metal corrosion. Table 5 shows the results.

TABLE 5

| Concentration N-cocoyl L-glutamate (CG) and Benzotriazole (BT) | Type of Water | pH | Amount of Corrosion on Filter Papers |
|---|---|---|---|
| 1 wt % CG<br>0.2 wt % BT | Deionized | 8.0 | No corrosion stain |
| 0.5 wt % CG<br>0.2 wt % BT | Deionized | 8.13 | No corrosion stain |
| 0.25 wt % CG<br>0.2 wt % BT | Deionized | 8.07 | No corrosion stain |
| 0.125 wt % CG<br>0.2 wt % BT | Deionized | 8.07 | One small spot of corrosion stain |
| 1 wt % CG<br>0.2 wt % BT | St. Louis County tap | 8.11 | One small spot of corrosion stain |
| 0.5 wt % CG<br>0.2 wt % BT | St. Louis County tap | 8.05 | One spot of corrosion stain |
| 0.25 wt % CG<br>0.2 wt % BT | St. Louis County tap | 8.04 | Multiple spots of corrosion stain |
| 0.125 wt % CG | St. Louis County tap | 8.01 | Multiple spots of |

TABLE 5-continued

| Concentration N-cocoyl L-glutamate (CG) and Benzotriazole (BT) | Type of Water | pH | Amount of Corrosion on Filter Papers |
|---|---|---|---|
| 0.2 wt % BT | | | corrosion stain |
| 1 wt % CG<br>0.2 wt % BT | Deionized | 7.0 | No corrosion stain |
| 0.5 wt % CG<br>0.2 wt % BT | Deionized | 7.0 | No corrosion stain |
| 0.25 wt % CG<br>0.2 wt % BT | Deionized | 7.0 | No corrosion stain |
| 0.125 wt % CG<br>0.2 wt % BT | Deionized | 7.0 | No corrosion stain |
| 1 wt % CG<br>0.2 wt % BT | St. Louis County tap | 7.0 | No corrosion stain |
| 0.5 wt % CG<br>0.2 wt % BT | St. Louis County tap | 7.15 | Multiple spots of corrosion stain |
| 0.25 wt % CG<br>0.2 wt % BT | St. Louis County tap | 7.19 | Heavy corrosion stain across paper |
| 0.125 wt % CG<br>0.2 wt % BT | St. Louis County tap | 7.08 | Heavy corrosion stain across paper |

The results demonstrate the effect that the inorganic content in tap water, particularly calcium and magnesium, has on inhibiting corrosion in ferrous metals.

What is claimed is:

1. A method of inhibiting corrosion in an aqueous metal working composition comprising:

adding a corrosion inhibiting composition to said aqueous metal working fluid composition in an amount effective to inhibit corrosion at a pH in the range of 6–12, wherein said corrosion inhibiting composition comprises:

(a) at least one amido acid or salt thereof having the formula

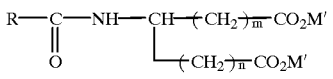

wherein R is an alkyl or alkenyl group having about 4 to about 21 carbon atoms, M and M' are cations independently selected from hydrogen, alkali metal or amine salts, and m and n independently represent an integer from 0 to 2; and (b) at least one of an aryltriazole having the formula

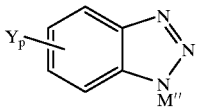

or 3-amino-1,2,4-triazole, wherein Y is an alkyl group having 1 to about 6 carbon atoms or —COO—$M^+$, M" is hydrogen or an alkali metal, and p is an integer from 0 to 4; wherein the molar ratio of (a) to (b) is about 0.34:1 to about 5:1.

2. The method of claim 1 wherein said corrosion inhibiting composition is present in the range of from 0.25 wt. % to about 2.5 wt. %, and said at least one amido acid or salt thereof is present at a level of at least 0.125 wt. % and said at least one of an aryltriazole or 3-amino-1,2,4-triazole is present at a level of at least 0.025 wt. %.

3. The method of claim 2 wherein said corrosion inhibiting composition is present in the range of from about 0.25 wt. % to about 2 wt. %, and said at least one amido acid or salt thereof is present at a level of at least 0.2 wt. % and said at least one of an aryltriazole or 3-amino-1,2,4-triazole is present at a level of at least 0.05 wt. %.

4. The method of claim 3 wherein said corrosion inhibiting composition is present in the range of from about 0.35 wt. % to about 1.8 wt. %, and said at least one amido acid or salt thereof is present at a level of at least 0.25 wt. % and said at least one of an aryltriazole or 3-amino-1,2,4-triazole is present at a level of at least 0.1 wt. %.

5. The method of claim 4 wherein said corrosion inhibiting composition is present in the range of from about 0.7 wt. % to about 1.5 wt. %, and said at least one amido acid or salt thereof is present at a level of at least 0.5 wt. % and said at least one of an aryltriazole or 3-amino-1,2,4-triazole is present at a level of at least 0.2 wt. %.

6. The method of claim 1 wherein said pH of said metal working composition is about 7 to about 10.

7. The method of claim 6 wherein said pH of said metal working composition is about 7.5 to about 9.5.

8. The method of claim 1 wherein m is 0 and n is 1 or 2.

9. The method of claim 8 wherein M" is hydrogen.

10. The method of claim 9 wherein p is 0 or 1 and Y is methyl, ethyl or butyl.

11. The method of claim 10 wherein (b) is an aryltriazole and said aryltriazole is benzotriazole or tolyltriazole.

12. The method of claim 11 wherein R is an alkyl group having 6 to 17 carbon atoms, and M and M' are independently hydrogen, alkali metal or trihydroxyalkylammonium.

13. The method of claim 11 wherein R is an alkyl group having 7 to 15 carbon atoms.

14. The method of claim 13 wherein at least one of M and M' is sodium, potassium or triethanolammonium.

15. The method of claim 1 wherein said aqueous metal working composition further comprises a polyaspartic polymer in the acid, salt or amide form thereof wherein the concentration of said polymer is in the range of from about 0.5 wt. % to about 70 wt. % of said aqueous metal working composition.

* * * * *